US009000986B2

(12) United States Patent
Teng et al.

(10) Patent No.: US 9,000,986 B2
(45) Date of Patent: Apr. 7, 2015

(54) HANDHELD DEVICE

(75) Inventors: Pei-Ling Teng, Taoyuan County (TW); Yi-Chun Chen, Taoyuan County (TW); Kuo-Cheng Chen, Taoyuan County (TW); Chung-Ting Hung, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 716 days.

(21) Appl. No.: 12/761,389

(22) Filed: Apr. 15, 2010

(65) Prior Publication Data

US 2011/0037662 A1 Feb. 17, 2011

(30) Foreign Application Priority Data

Aug. 13, 2009 (TW) ..... 98127288 A

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 9/42*** | (2006.01) |

(52) U.S. Cl.

CPC ..... *H01Q 1/243* (2013.01); *H01Q 1/48* (2013.01); *H01Q 9/0421* (2013.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 2007/0057854 | A1 | 3/2007 | Oodachi et al. | |
| 2008/0316121 | A1 * | 12/2008 | Hobson et al. | 343/702 |
| 2009/0079639 | A1 * | 3/2009 | Hotta et al. | 343/702 |
| 2009/0096683 | A1 | 4/2009 | Rosenblatt et al. | |

FOREIGN PATENT DOCUMENTS

| | | |
|---|---|---|
| CN | 101026939 | 8/2007 |
| CN | 101043101 | 9/2007 |
| CN | 201185225 | 1/2009 |
| CN | 101385193 | 3/2009 |

OTHER PUBLICATIONS

"First Office Action of China Counterpart Application", issued on Sep. 26, 2012, p. 1-p. 6.
"European Search Report of Europe Counterpart Application," Issued on Aug. 26, 2010, p. 1-p. 3.
"First Office Action of Europe Counterpart Applition," Issued on Sep. 10, 2010, p. 1-p. 5.
"Second Office Action of China Counterpart Application", issued on Mar. 18, 2013, p. 1-p. 7.

* cited by examiner

*Primary Examiner* — Graham Smith
(74) *Attorney, Agent, or Firm* — Jianq Chyun IP Office

(57) ABSTRACT

A handheld device includes an antenna area and an outer frame, wherein the outer frame includes a frame body and a carrier. The antenna area is for transmitting a radio frequency signal with a first wavelength and has a ground part and a feeding part. In addition, the ground part within the antenna area is electrically connected to a ground plane. The frame body of the outer frame has an extended area corresponding to the antenna area to form a projected feeding point. The carrier of the outer frame is disposed at the peripheral area of the opening of the frame body, wherein the peripheral area of the frame body has a first ground point electrically connected to the ground plane, and the spacing between the first ground point and the projected feeding point is correlated to the first wavelength.

12 Claims, 11 Drawing Sheets

HANDHELD DEVICE

CROSS-REFERENCE TO RELATED APPLICATION

This application claims the priority benefit of Taiwan application serial No. 98127288, filed on Aug. 13, 2009. The entirety of the above-mentioned patent application is hereby incorporated by reference herein and made a part of this specification.

BACKGROUND OF THE INVENTION

1. Field of the Invention

The present invention generally relates to a handheld device, and more particularly, to a device having a metallic frame body on which at least a ground point is disposed.

2. Description of Related Art

An antenna is one of indispensable parts for comprising a wireless communication device. In fact, the antenna is vital for the communication quality and the applicable range of a wireless communication device. Along with the popularity of wireless communication devices, it is increasingly paid attention the issue regarding the impact of the electromagnetic wave radiated from an antenna on human body. In this regard, The Federal Communications Commission (FCC) has defined the specific absorption ratio (SAR) of a wireless communication device so as to restrict the permissible radiation energy or the maximum permissible radiation limit.

Among many antenna architectures, the planar inverted F antenna (PIFA) is advantageous in small SAR, low cost, high radiation efficiency and easiness of miniaturization design, etc., so that the PIFA is broadly used in wireless communication devices. FIG. 1A is a cross-sectional diagram of a traditional PIFA. Referring to FIG. 1A, a PIFA 100 includes an antenna radiator 110, a feeding portion 111 and a ground portion 112, wherein the ground portion 112 is electrically connected to a ground plane on a printed circuit board (PCB) 120 and the feeding portion 111 is for delivering the signal received by the antenna radiator 110 to an integrated circuit (IC) on the PCB 120.

Generally, the bandwidth of the PIFA 100 is directly proportional to the height of the antenna. In other words, the larger the spacing between the PIFA 100 and the PCB 120, the wider the bandwidth thereof is. However, the larger spacing would make the antenna unable to meet the requirement of a communication device oriented by thin-shape style design. In order to improve the situation, a traditional hybrid antenna is provided. FIG. 1B is a cross-sectional diagram of a traditional hybrid antenna. Referring to FIG. 1B, a PIFA 100 is corresponding to a clearance area 130 so as to form a hybrid antenna, where the PIFA 100 corresponding to the clearance area 130 has a sufficient bandwidth to overcome the restriction of the height.

It should be noted that the most of the modern wireless communication devices have a style design with metallic sense so as to attract the attentions of the consumers. With such design idea, the most portions of the body of a wireless communication device is clad by metal (for example, metallic frame), which is unable to form a clearance area serving for the PIFA; or in a better situation, there is an overlapping portion formed between the antenna area and the metallic frame. In this regard, the most of the modern wireless communication devices are unable to adopt a hybrid antenna to overcome the restriction of the antenna height.

SUMMARY OF THE INVENTION

Accordingly, the present invention is directed to a handheld device able to reduce the influence of the outer frame thereof on an antenna area by disposing at least a ground point on the outer frame.

The present invention provides a handheld device, which includes an antenna area and an outer frame, wherein the outer frame includes a frame body and a carrier. The antenna area herein is for transmitting a radio frequency signal with a first wavelength (an RF signal with a first wavelength) and has a ground part and a feeding part. In addition, the ground part within the antenna area is electrically connected to a ground plane. The surface of the frame body of the outer frame is overlaid by a metallic thin film and has an extended area corresponding to the antenna area to form a feeding projection point. The carrier of the outer frame is disposed at the peripheral area of the opening of the frame body, wherein the peripheral area of the frame body has a first ground point electrically connected to the ground plane, and the spacing between the first ground point and the feeding projection point is correlated to the first wavelength.

In an embodiment of the present invention, the above-mentioned spacing between the first ground point and the feeding projection point ranges between one fifteenth and one thirtieth of the first wavelength.

In an embodiment of the present invention, the above-mentioned antenna area is further for transmitting an RF signal with a second wavelength, and the peripheral area of the frame body further has a second ground point electrically connected to the ground plane, wherein the length of a first current path formed along the outer frame between the first ground point and the second ground point is equal to a half of the second wavelength.

In an embodiment of the present invention, the above-mentioned antenna area is further for transmitting an RF signal with a third wavelength, and the peripheral area of the frame body further has a third ground point electrically connected to the ground plane, wherein the length of a second current path formed along the outer frame between the first ground point and the third ground point is equal to a half of the third wavelength, and the first current path and the second current path are not overlapped by each other.

In an embodiment of the present invention, the above-mentioned handheld device further includes a substrate, a metallic inner-frame and a conductive material layer, wherein the substrate is opposite to the outer frame, and the antenna area is electrically connected to the ground plane via the ground part. The metallic inner-frame is knocked at the carrier and electrically connected to the ground plane. The conductive material layer takes the first ground point as the base and overlays the frame body, the carrier and the metallic inner-frame thereon, so that the first ground point is electrically connected to the ground plane via the conductive material layer and the metallic inner-frame.

Based on the mentioned above, in the present invention, at least a ground point (auxiliary ground point) is disposed on the conductive frame body, wherein the disposed position of the ground point is the place where the strongest current density of the frame body occurs. In comparison with the prior art, the ground point on the frame body functions to prevent the destructive resonance produced by the frame body under a specific operation frequency from affecting the operation bandwidth within the antenna area. As a result, the handheld device of the present invention is allowed to dispose the outer frame with metallic gloss surface to enhance the outlook value thereof and to fit the advanced visual integrity design principle.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
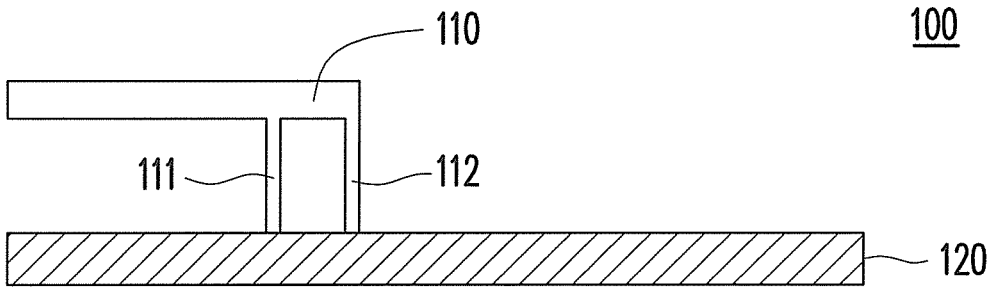
FIG. 1A (RELATED ART)
FIG. 1A is a cross-sectional diagram of a traditional PIFA.
Figure 1B:
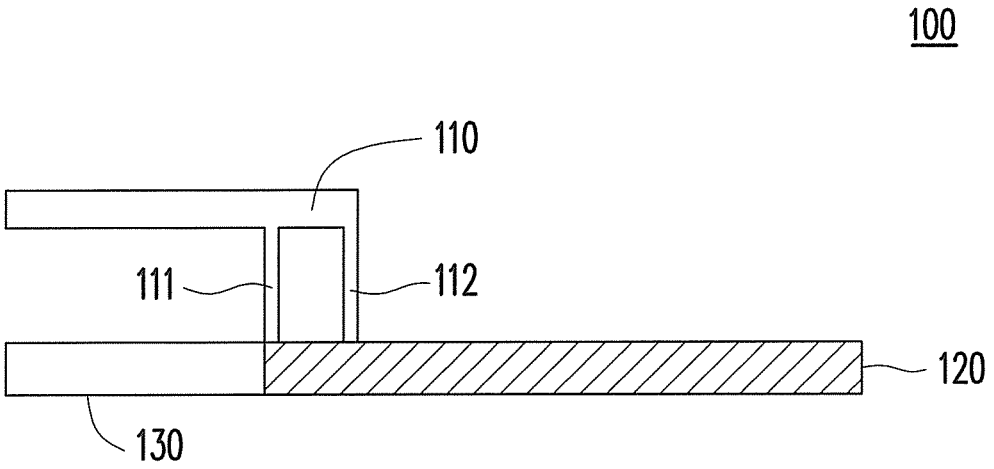
FIG. 1B (RELATED ART)
FIG. 1B is a cross-sectional diagram of a traditional hybrid antenna.

Reference will now be made in detail to the present preferred embodiments of the invention, examples of which are illustrated in the accompanying drawings. Wherever possible, the same reference numbers are used in the drawings and the description to refer to the same or like parts.

Figure 2:
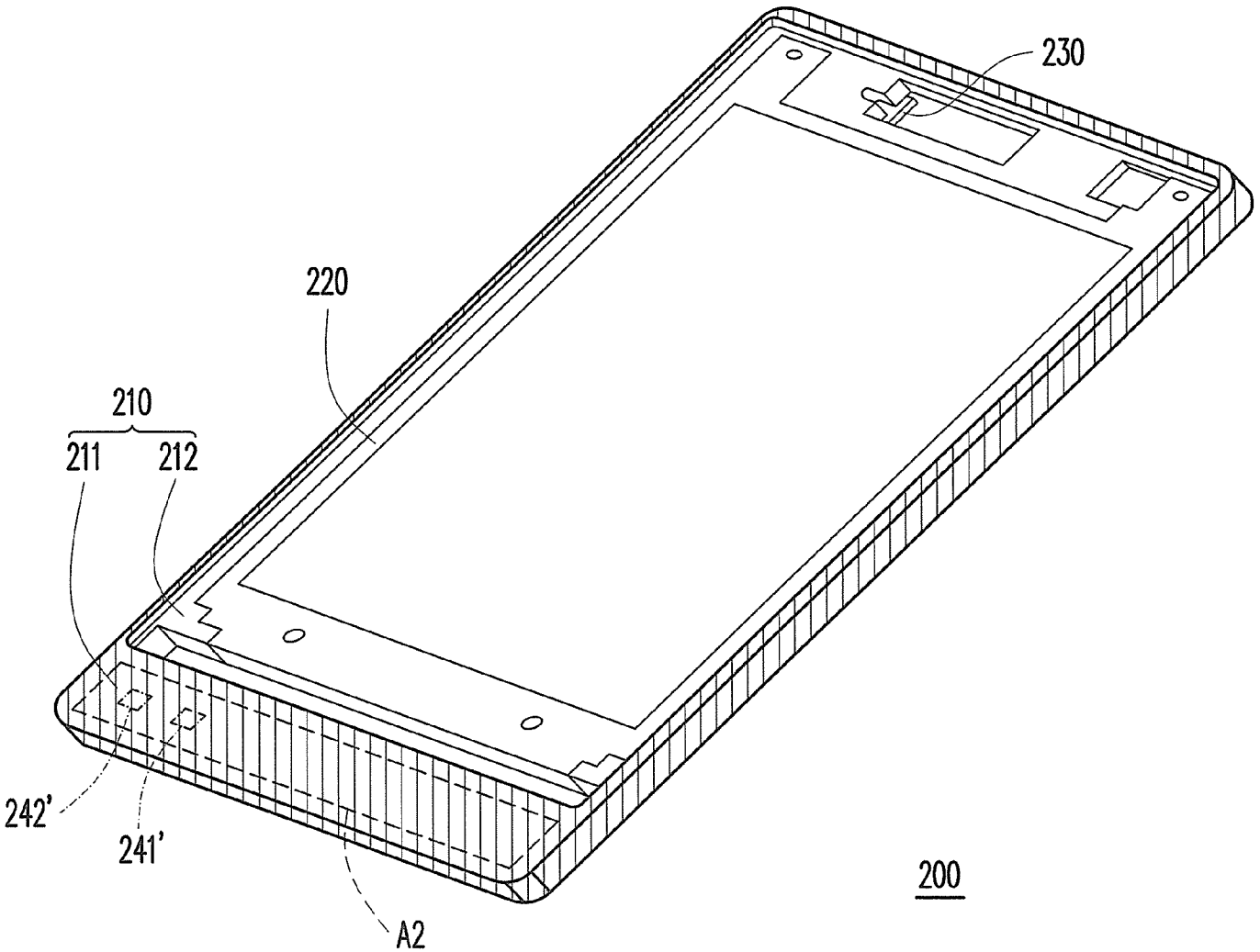
FIG. 2 is an assembly diagram of a handheld device according to an embodiment of the present invention.

FIG. 2 is an assembly top-view diagram of a handheld device according to an embodiment of the present invention. Referring to FIG. 2, a handheld device 200 includes an outer frame 210, a metallic inner-frame 220 and a substrate 230, wherein the outer frame 210 includes a frame body 211 and a carrier 212.

In the embodiment, the outer frame 210 is made of plastic. In order to fit the style design requirement of metallic sense, the surface of the frame body 211 of the outer frame 210 is overlaid by a layer of metallic thin film, which further makes the frame body 211 of the outer frame 210 conductive. On the other hand, the carrier 212 is disposed at the peripheral area of the opening of the frame body 211. The metallic inner-frame 220 is engaged with the carrier 212 and thereby partially overlapped with the carrier 212, wherein the carrier 212 is made of nonconductive material (for example, plastic). Besides, the substrate 230 is opposite to the inner surface of the outer frame 210. In this way, the metallic inner-frame 220, the carrier 212 and the substrate 230 together form an overlapping architecture top-down arranged sequentially.

The frame body 211 can be made of conductive material as well. If the conductive material itself possesses the required metallic gloss and the metallic sense, there is no need to additionally employ a layer of metallic thin film for overlaying. However, if the frame body 211 formed by the conductive material does not conform the outlook requirement of metallic gloss, a proper layer of metallic thin film is needed for overlaying on the surface of the frame body 211. It should be noted that regardless of the conductive material or the nonconductive material selected to compose the frame body 211 and no matter whether or not a layer of metallic thin film is used for the overlapping, considering the carrier 212 is sandwiched by the frame body 211 and the metallic inner-frame 220, the frame body 211 and the metallic inner-frame 220 are not electrically connected to each other. However, when a conductive material layer is disposed at an appropriate place of the carrier 212, the frame body 211 and the metallic inner-frame 220 can be electrically connected to each other, which would be depicted in details hereinafter.

Figure 3:
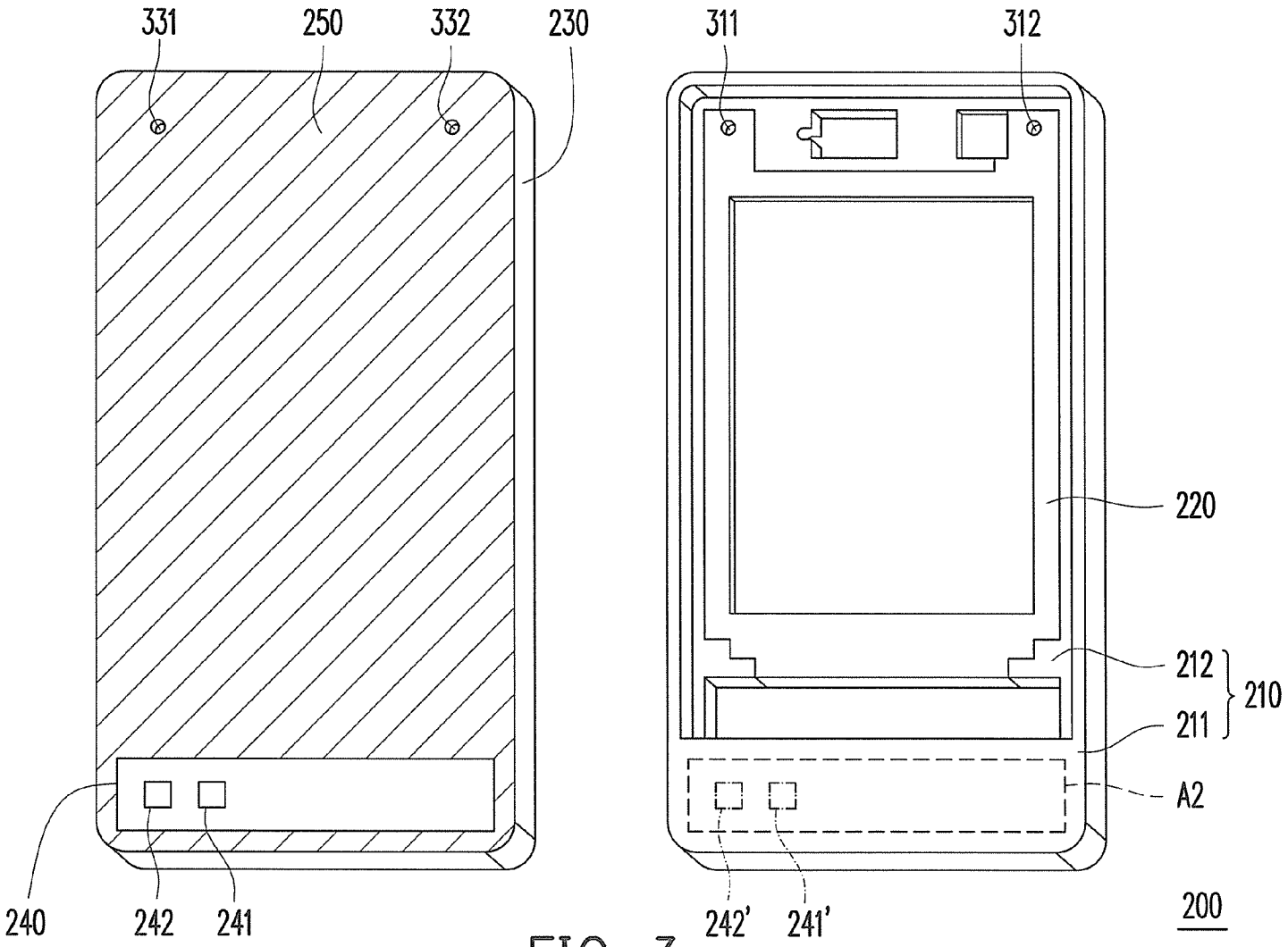
FIG. 3 is an exploded view diagram of the handheld device of FIG. 2.

For depiction convenience, FIG. 3 is presented and is an exploded view diagram of the handheld device of FIG. 2. Referring to FIGS. 2 and 3, the handheld device 200 further includes an antenna area 240 and a ground plane 250, wherein the antenna area 240 includes a ground part 241 and a feeding part 242. For the implementation, the antenna area 240 can include an antenna radiator (not shown) therewithin. The antenna radiator is electrically connected to the ground plane 250 on the substrate 230 via the ground part 241. In addition, the frame body 211, opposite to the antenna area 240, of the outer frame 210 can be considered as an extended area A2. Further, the ground part 241 and the feeding part 242 within the antenna area 240 would be projected onto the extended area A2 of the frame body 211 along the direction perpendicular to the extended area A2, to form two projected positions within the extended area A2, respectively marked as a projected ground point 241' and a projected feeding point 242', are obtained.

In terms of the integral actions of the handheld device 200, the handheld device 200 transmits or receives RF signals through the antenna radiator within the antenna area 240. When the handheld device 200 is operated within an RF band, the antenna radiator can transmit a plurality of RF signals respectively having a different center frequency depending on the divided frequency channels of the RF band, which means the handheld device 200 can transmit a plurality of RF signals with different wavelengths through the antenna radiator. It should be noted that during receiving and transmitting wireless signals over the antenna area 240, the conductive frame body 211 and the antenna area 240 would interact with each other, which creates destructive resonance modes on certain center frequencies.

In order to avoid the resonance modes created by the frame body 211 affecting the quality of receiving and transmitting wireless signals by the handheld device 200, a plurality of ground points (i.e., auxiliary ground points which function to reduce the resonance effect created by the frame body within the operation bandwidth) are disposed at the peripheral area of the frame body 211. The above-mentioned ground points and the feeding part 242 within the antenna area 240 are electrically connected to the ground plane 250, and the disposing positions of the ground points are related to the center frequencies at which the frame body 211 may create the above-mentioned resonances. In following, it is depicted that how the plurality of ground points on the frame body 211 are electrically connected to the ground plane 250 and the relation between the disposing positions of the ground points and the corresponding center frequencies.

Figure 4:
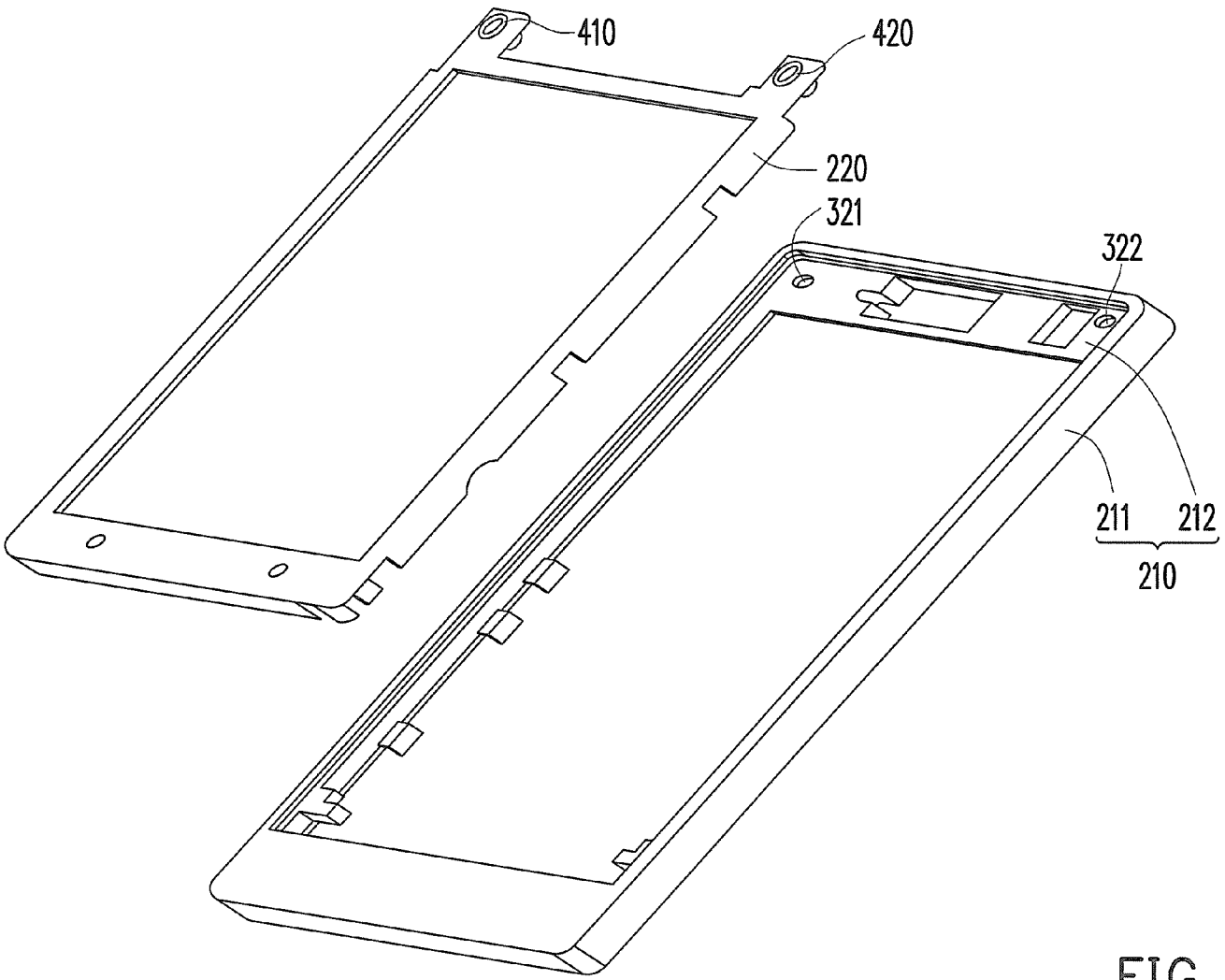
FIG. 4 is an exploded view diagram showing an outer frame and a metallic inner-frame.

FIG. 4 is an exploded view diagram showing an outer frame and a metallic inner-frame. Referring to FIGS. 3 and 4, the handheld device 200 further includes a plurality of fastening elements 410-420, wherein the fastening elements 410-420 are, for example, traditional screws or ceramic screws. In the embodiment, the metallic inner-frame 220, the carrier 212 of the outer frame 210 and the substrate 230 respectively include a plurality of fastening holes. For example, the metallic inner-frame 220 includes fastening holes 311-312, the carrier 212 of the outer frame 210 includes fastening holes 321-322, and the substrate 230 includes fastening holes 331-332.

As per the overlapping architecture of the metallic inner-frame 220, the carrier 212 and the substrate 230, the fastening hole 311 of the metallic inner-frame 220, the fastening hole 321 of the carrier 212 and the fastening hole 331 of the substrate 230 are corresponding to each other, and the fastening hole 312 of the metallic inner-frame 220, the fastening hole 322 of the carrier 212 and the fastening hole 332 of the substrate 230 are corresponding to each other as well. In this way, the fastening elements 410-420 can pass through the metallic inner-frame 220, the carrier 212 and the substrate 230 through the fastening holes 311-312, 321-322 and 331-332, and thereby the metallic inner-frame 220 and the carrier 212 are fixed on the substrate 230. It should be noted that the fastening elements 410-420 are made of metal and the ground plane 250 is disposed on the substrate 230, hence, the metallic inner-frame 220 can be electrically connected to the ground plane 250 through the fastening elements 410-420.

Figure 5B:
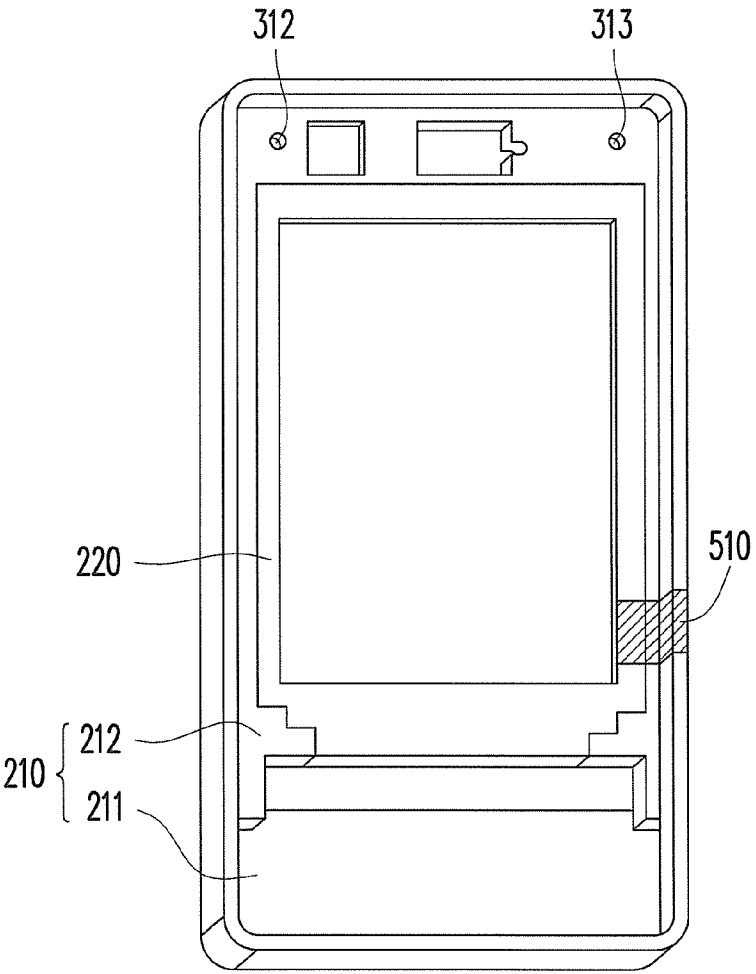
FIGS. 5A and 5B are two assembly diagrams respectively showing the top-view and the back-view of the outer frame and the metallic inner-frame of FIG. 4.
Figure 5A:
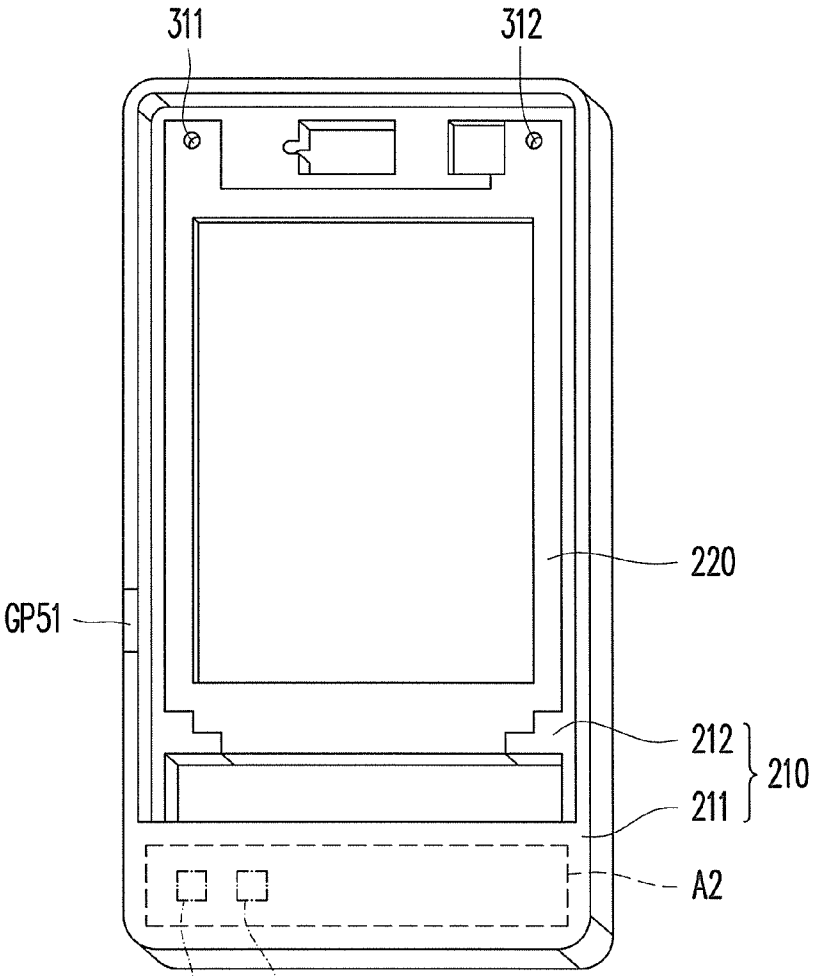

FIGS. 5A and 5B are two assembly diagrams respectively showing the top-view and the back-view of the outer frame and the metallic inner-frame of FIG. 4. Referring to FIG. 5A, in top-view to watch the outer frame 210 and the metallic inner-frame 220, there is a ground point GP51 disposed at the lower-left corner of the frame body 211 of the outer frame 210. The handheld device 200 further includes a conductive material layer 510, as shown in FIG. 5B. The conductive material layer 510 is disposed with respect to the ground point GP51. Therefore, in back-view to watch the outer frame 210 and the metallic inner-frame 220, the conductive material layer 510 is located at the lower-right corner thereof. Meanwhile, the conductive material layer 510 overlays the metal thin film of the frame body 211, the carrier 212 and the metallic inner-frame 220 thereon with respect to the ground point GP51.

The ground point GP51 of the frame body 211 is electrically connected to the metallic inner-frame 220 via the conductive material layer 510, and the metallic inner-frame 220 is electrically connected to the ground plane 250 via the fastening elements 410-420; as a result, the ground point GP51 located on the frame body 211 can be electrically connected to the ground plane 250 sequentially via the conductive material layer 510, the metallic inner-frame 220 and the fastening elements 410-420. In the embodiment, the electrical connection between the frame body 211 and the metallic inner-frame 220 can be realized by the following methods: spraying conductive paint or adhering a conductive sticker or a conductive tape on the inner surfaces of the outer frame 210 and metallic inner-frame 220. It even can be realized by making an opening on the carrier 212 and then placing a metallic spring slip between the outer frame 210 and the metallic inner-frame 220.

Figure 6:
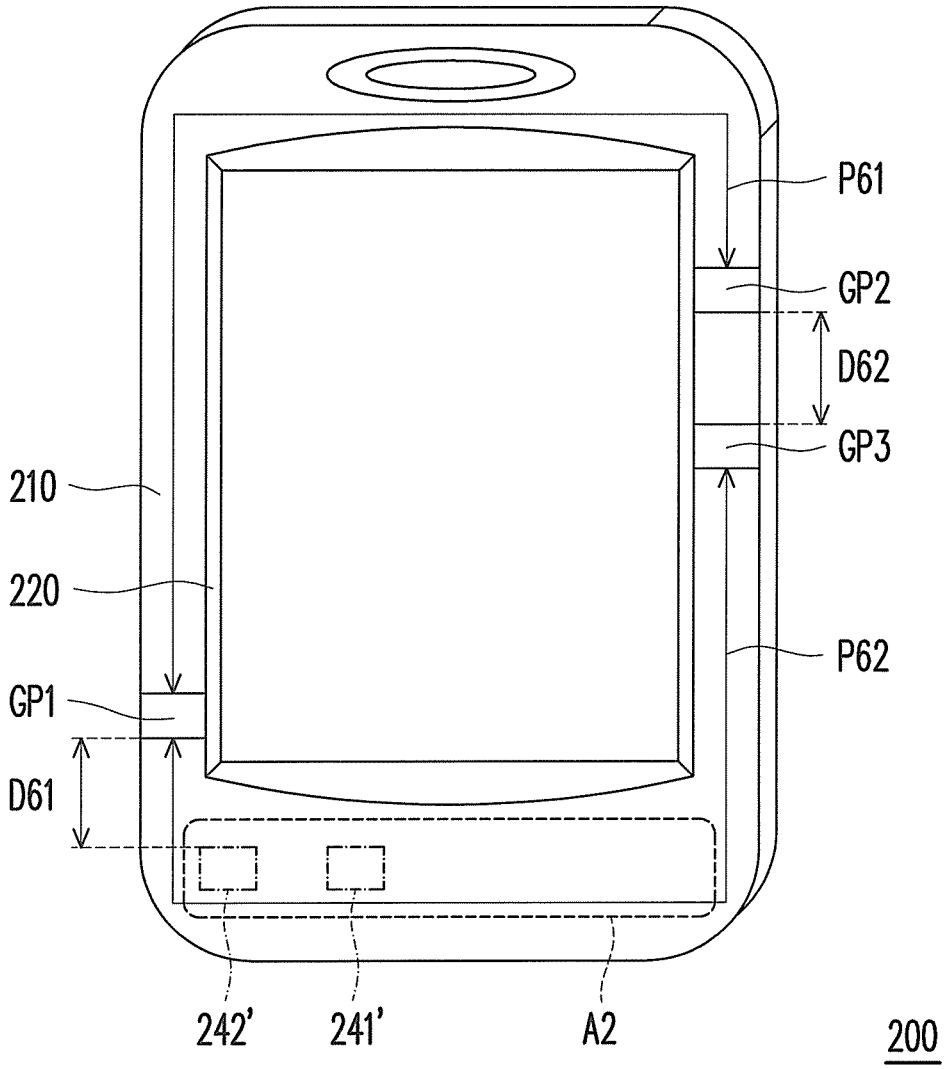
FIG. 6 is a structure diagram of a handheld device according to an embodiment of the present invention.

FIGS. 5A and 5B are used mainly for explaining how the ground point on the frame body 211 is electrically connected to the ground plane 250. In following, how the disposing position of the ground point is determined is depicted in details. FIG. 6 is a structure diagram of a handheld device according to an embodiment of the present invention. For depiction simplicity, only the outer frame 210 and the metallic inner-frame 220 are denoted in FIG. 6, the other detail structure of the handheld device 200 can refer to the above-mentioned embodiments.

Prior to depicting the disposing positions of the ground points, it is assumed the antenna area 240 can be used in the communication frequency bands defined by the standards GSM 850, GSM 900, DCS 1800 and PCS 1900. When the center frequencies of the RF signals transmitted by the handheld device 200 are at the first frequency, the second frequency and the third frequency (for example, 900 MHz, 754 MHz and 808 MHz), the above-mentioned conductive frame body 211 can create destructive resonance modes to affect the communication quality of the antenna area 240. The RF signals with center frequencies of the first frequency, the second frequency and the third frequency under the operation frequencies have the wavelengths respectively denoted as first wavelength $\lambda 1$, second wavelength $\lambda 2$ and third wavelength $\lambda 3$.

In the real applications, when the handheld device 200 is operated at the first frequency, the second frequency and the third frequency, the conductive frame body 211 itself creates destructive resonance modes correspondingly to the resonances with a half of wavelength $\lambda 1$, a half of wavelength $\lambda 2$ and a half of wavelength $\lambda 3$, respectively. In order to avoid the resonance of the frame body 211 from affecting the communication quality of the antenna area 240, in the embodiment, it is preferred to respectively dispose the first ground point GP1, the second ground point GP2 and the third ground point GP3 on the frame body 211 of the outer frame 210, wherein the disposing positions of the first-third ground points GP1-GP3 are correlated to the wavelengths $\lambda 1 \sim \lambda 3$. As shown in FIG. 6 for example, the spacing D61 between the first ground point GP1 and the feeding projection point 242' ranges between 1/15 and 1/30 of the first wavelength $\lambda 1$ (under the first operation frequency), wherein the preferred disposing position is corresponding to, for example, 1/20 of the first wavelength $\lambda 1$. In addition, the length of a first current path P61 formed along the outer frame 210 between the first ground point GP1 and the second ground point GP2 is a half of the second wavelength $\lambda 2$ (under the second operation frequency).

The length of a second current path P62 formed along the outer frame 210 between the first ground point GP1 and the third ground point GP3 is a half of the third wavelength $\lambda 3$ (under the third operation frequency), and the first current path P61 and the second current path P62 are not overlapped by each other. The spacing D62 between the second ground point GP2 and the third ground point GP3 is approximate to the spacing D61 between the first ground point GP1 and the feeding projection point 242'. In this way, the ground points are disposed at the places on the frame body 211 of the outer frame 210 where the strongest current density occurs, which would reduce the negative impact of the resonance of the frame body 211 on the antenna area 240.

Figure 7:
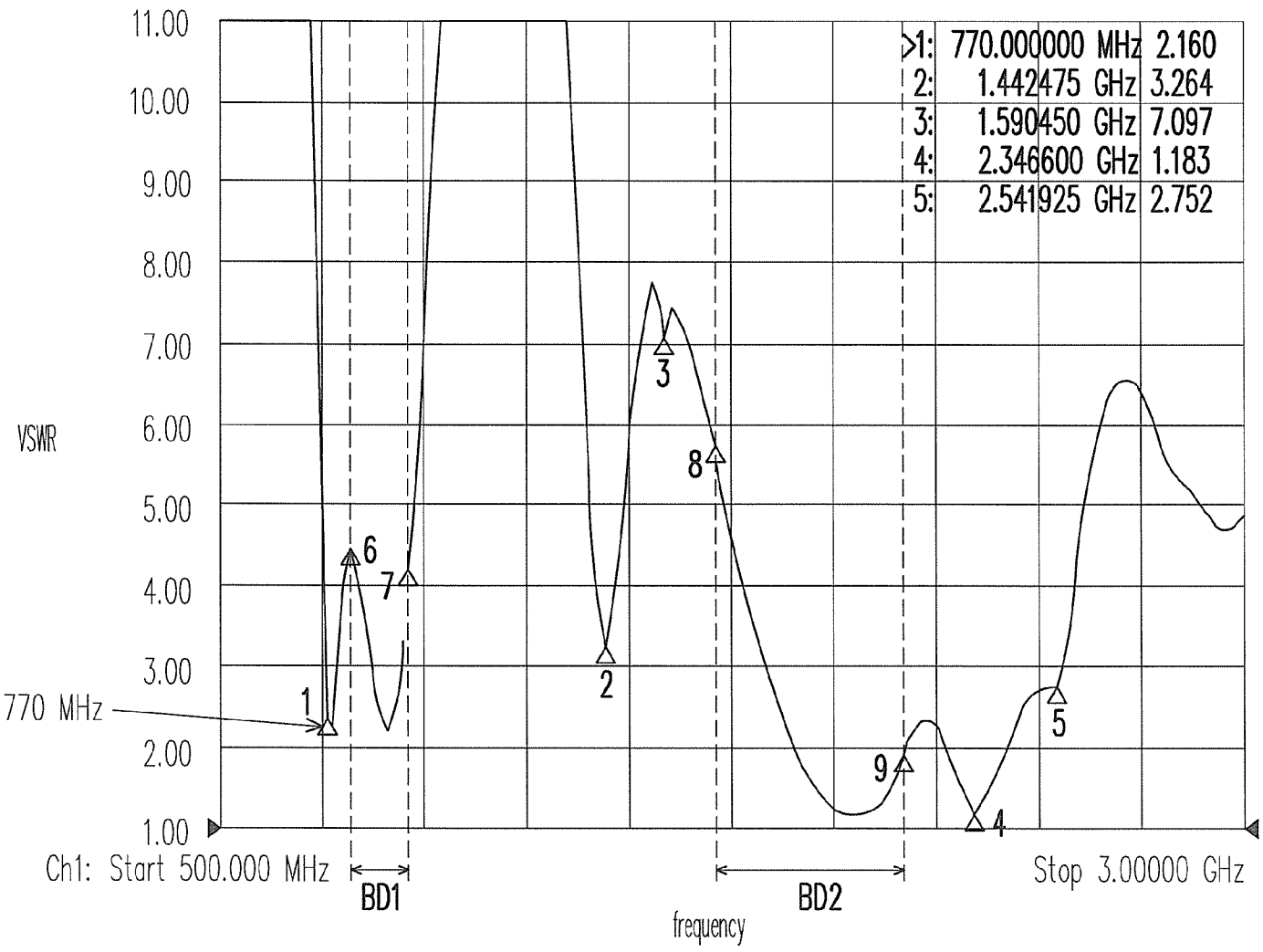
FIG. 7 is a graphical chart showing the voltage standing wave ratio (VSWR) of the antenna area 240 when the frame body 211 does not dispose a ground point.
Figure 8:
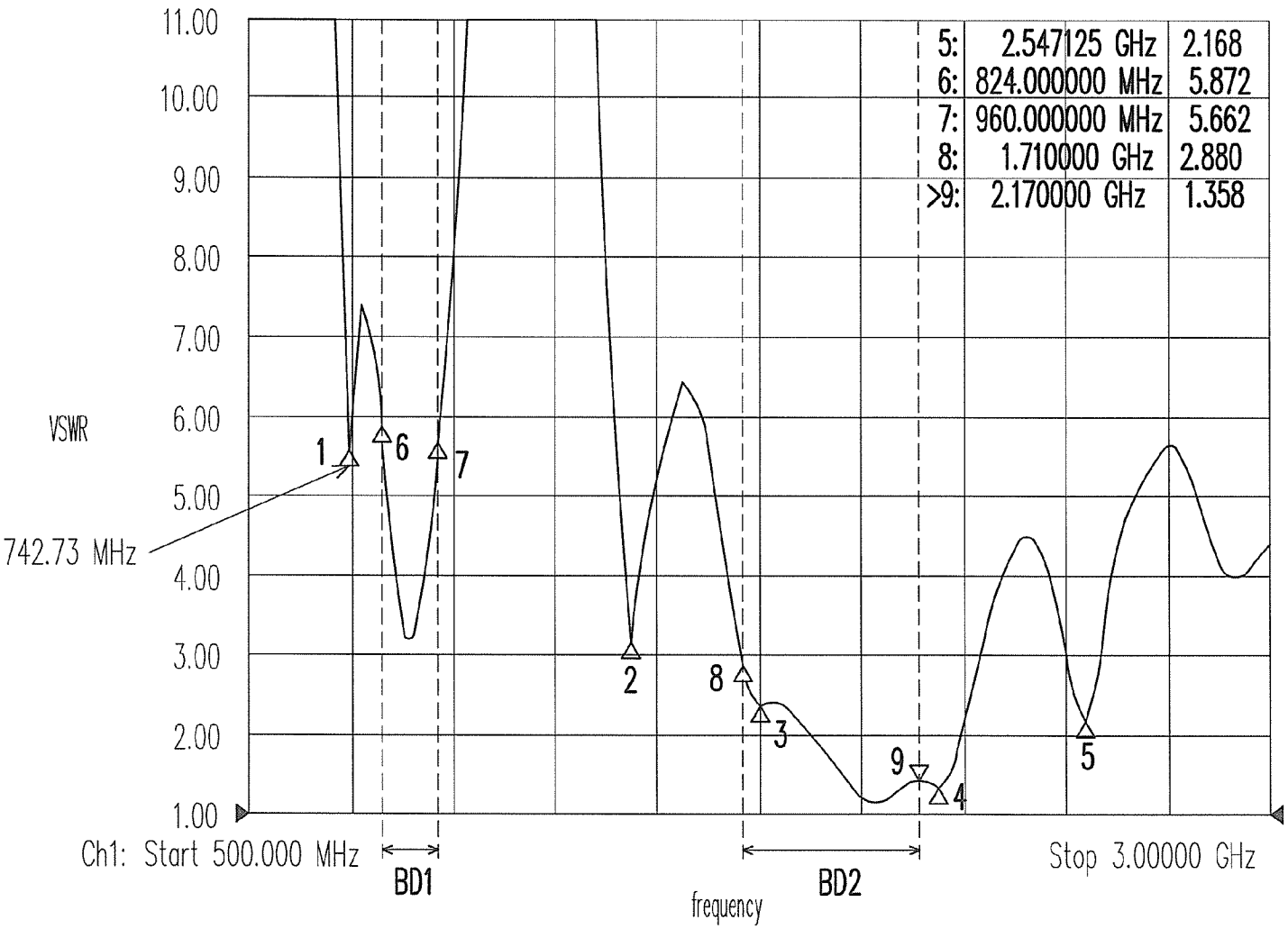
FIG. 8 is a graphical chart showing the VSWR of the antenna area 240 when the frame body 211 disposes a first ground point GP1.

FIGS. 7 and 8 are given to exemplarily explain the above-mentioned influences. FIG. 7 is a graphical chart showing the voltage standing wave ratio (VSWR) of the antenna area 240 without disposing a ground point on the frame body 211 and FIG. 8 is a graphical chart showing the VSWR of the antenna area 240 when disposing a first ground point GP1 on the frame body 211, wherein BD1 represents the frequency band under the communication standards GSM 850 and GSM 900, and BD2 represents the frequency band under the communication standards DCS 1800, PCS 1900 and WCDMA Band I. Referring to FIGS. 7 and 8, due to disposing the first ground point GP1, the looped current path of the antenna area 240 would be accordingly increased, which would reduce the frequency of the baseband signal of the resonance created by the frame body 211 from 770 MHz down to 742.73 MHz. In this way, it is avoided to create the destructive resonance mode under the operation frequency by the frame body 211, and therefore, the frequency bands BD1 and BD2 operated within the antenna area 240 are not affected.

Figure 9:
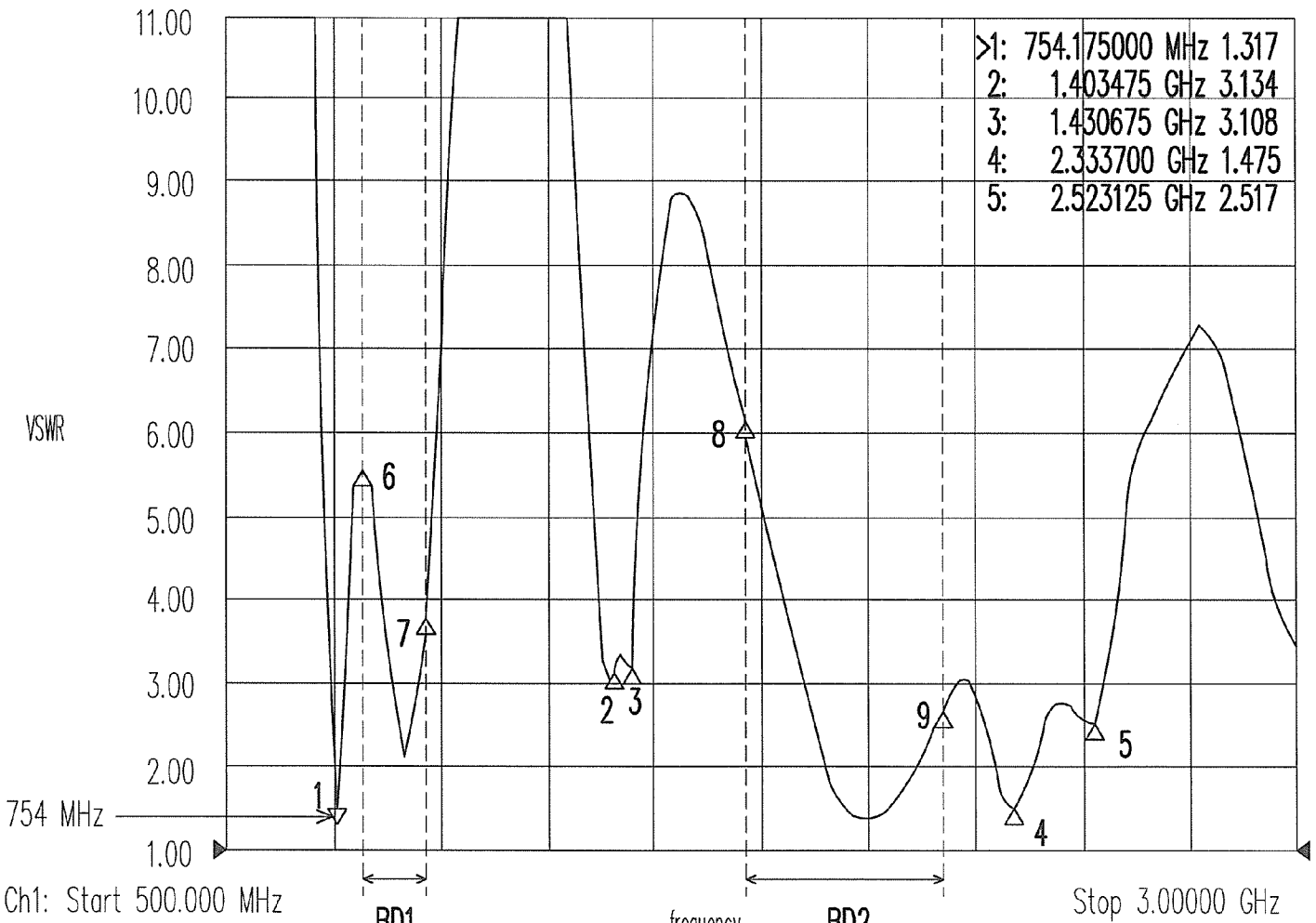
FIG. 9 is a graphical chart showing the VSWR of the antenna area 240 when the frame body 211 disposes a first ground point GP1 and a second ground point GP2.
Figure 10:
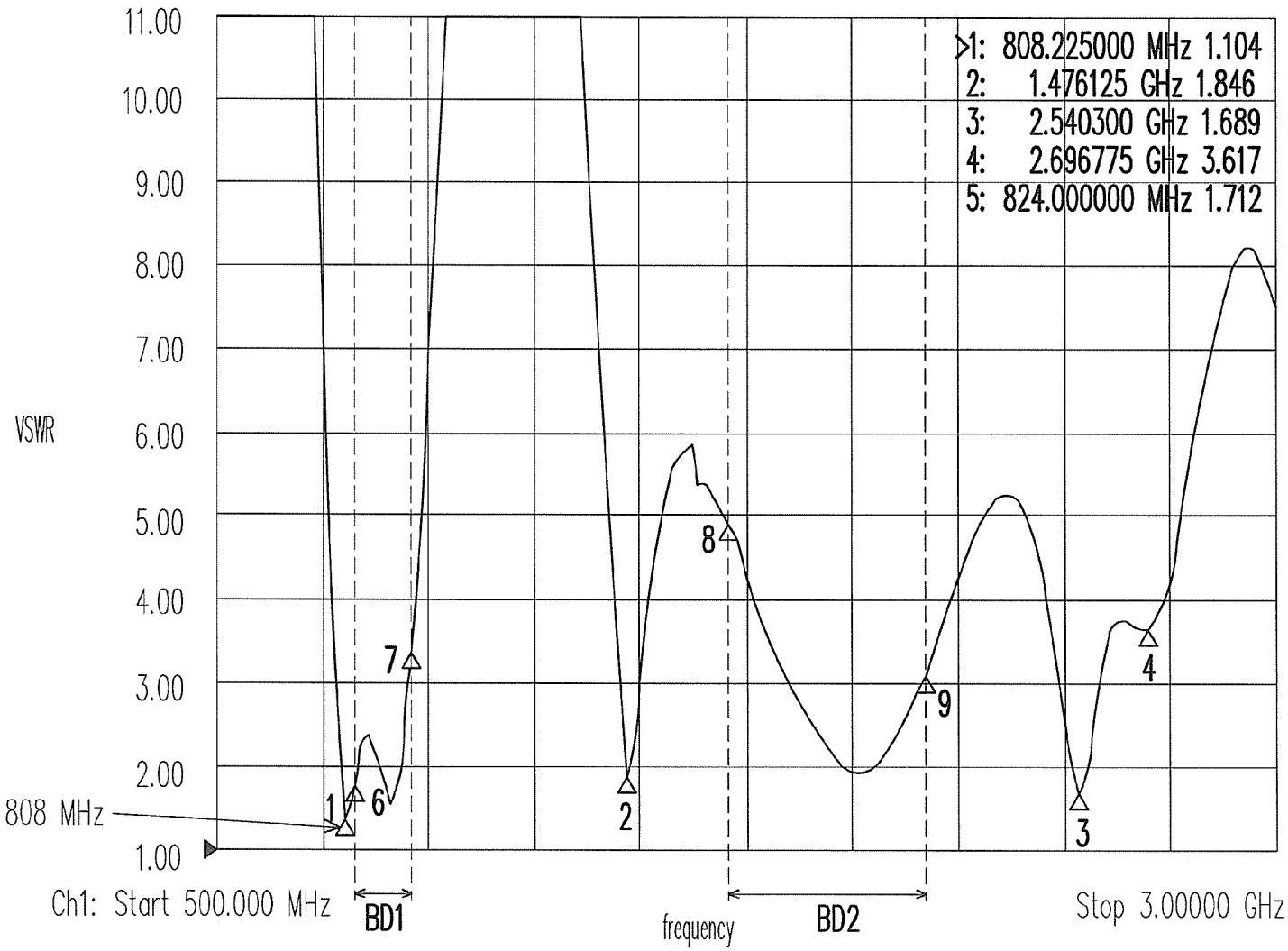
FIG. 10 is a graphical chart showing the VSWR of the antenna area 240 when the frame body 211 disposes a first ground point GP1, a second ground point GP2 and a third ground point GP3.

FIG. 9 is a graphical chart showing the VSWR of the antenna area 240 when the frame body 211 disposes a first ground point GP1 and a second ground point GP2 and FIG. 10 is a graphical chart showing the VSWR of the antenna area 240 when the frame body 211 disposes a first ground point GP1, a second ground point GP2 and a third ground point GP3. Referring to FIGS. 8-10, due to disposing the second ground point GP2 and the third ground point GP3, the frequency of the baseband signal of the resonance created by the frame body 211 would be altered somehow, and the frequencies of the harmonic waves of the resonance created by the frame body 211 are accordingly adjusted. In other words, by introducing the second ground point GP2 and the third ground point GP3, the frequency ratios of the harmonic wave components over the baseband signal of the resonance created by the frame body 211 are altered, which further reduces the influences of the harmonic wave components of the resonance created by the frame body 211 on the antenna area 240.

Figure 11:
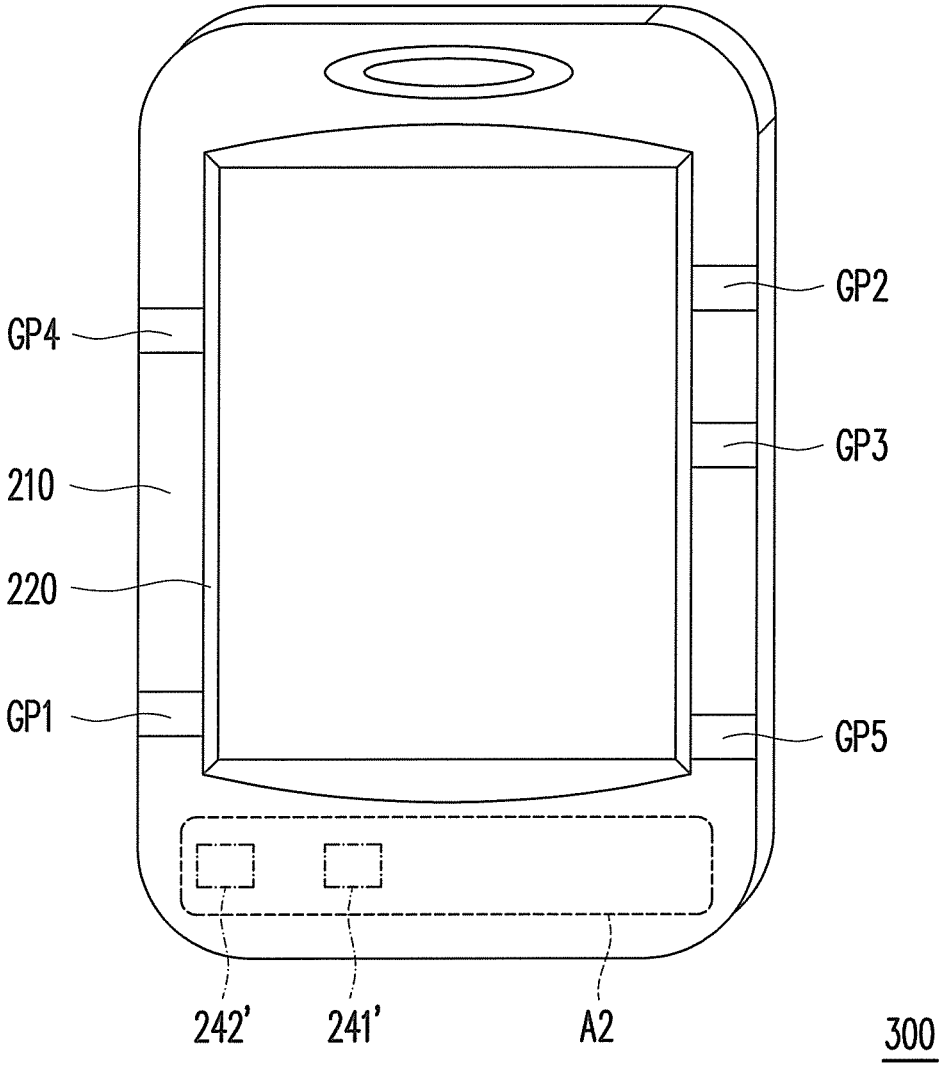
FIG. 11 is a structure diagram of a handheld device according to another embodiment of the present invention.

It can be seen in FIGS. 8-10 that the first ground point GP1 on the frame body 211 is mainly for adjusting the frequency of the baseband signal of the resonance created by the frame body 211 (corresponding to low-frequency signal), and the second ground point GP12 and the third ground point GP3 on the frame body 211 are mainly for adjusting the frequencies of the harmonic waves of the resonance created by the frame body 211 (corresponding to high-frequency signals). As a result, the destructive resonance created by the frame body 211 is moved to out-band which is out of the frequency bands BD1 and BD2 operated by the antenna area 240. It should be noted that there is another solution as shown by FIG. 11. FIG. 11 is a structure diagram of a handheld device according to another embodiment of the present invention. Comparing FIGS. 6 and 8, the most difference of the handheld device 300 in FIG. 11 from the handheld device 200 in FIG. 6 rests in that additional a four ground point GP4 and a fifth ground point GP5 are disposed on the outer frame 210 of the handheld device 300.

The minimum total radiation power (minimum TRP) and the minimum total isotropic sensitivity (minimum TIS) corresponding to the two antennas in the handheld devices 300 and 200 under the above-mentioned communication standards are measured and shown in Table 1.

TABLE 1

| | GSM 850 | DCS 1800 | PCS 1900 | WCDMA Band I |
|---|---|---|---|---|
| Minimum TRP (dBm) | | | | |
| handheld device 300 | 26 | 24.3 | 25 | 19.3 |
| handheld device 200 | 29.02 | 25.4 | 25.04 | 19.59 |
| Minimum TIS (dBm) | | | | |
| handheld device 300 | −100.6 | −103.2 | −103.6 | −104.6 |
| handheld device 200 | −104.3 | −104.8 | −104.6 | −105.7 |

It can be seen from Table 1 that by disposing the additional two ground points GP4 and GP5 on the handheld device 300, the measured TRP and TIS of the antenna have little variation in comparison with the handheld device 200. In other words, if the ground points are arbitrarily disposed on the frame body 211 of the outer frame 210 (not disposed at the above-mentioned places where the maximum current flows through), the influence of the frame body 211 on the antenna area 240 can not be reduced.

In summary, the present invention features to dispose ground points (auxiliary ground points) on the conductive frame body of the handheld device and the disposing positions thereof are the places on the frame body where the strongest current density occurs. In this way, the coupling effect between the antenna and the frame body is accordingly changed with disposing the ground points, and thereby the destructive resonance modes created by the frame body under the operation frequency does not affect the operation frequency band within the antenna area. In addition, the outer frame of the handheld device provided by the present invention, due to the above-mentioned feature, is allowed to be clad by metallic film to posses metallic gloss, which is advantageous in enhancing the outlook beauty of a handheld device to conform the advanced visual integrity design principle.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A handheld device, comprising:

an antenna area, having an antenna radiator, a ground part and a feeding part, wherein the antenna radiator is configured to transmit a radio frequency signal with a first wavelength and the ground part is electrically connected to a ground plane; and an outer frame, comprising:

a frame body, having an extended area, wherein the extended area overlaps with and is opposite to the antenna area to form a projected feeding point produced by an orthogonal projection of the feeding part on the frame body, the frame body is integrally formed with conductive material, and the extended area is a part of the frame body and formed with conductive material; and a carrier, disposed at a peripheral area of an opening of the frame body, wherein the peripheral area of the frame body has a first ground point electrically connected to the ground plane, the spacing between the first ground point and the projected feeding point is correlated to the first wavelength, and the first ground point is the spot on the frame body with the strongest current density.

2. The handheld device as claimed in claim 1, wherein the spacing between the first ground point and the projected feeding point ranges from one fifteenth to one thirtieth of the first wavelength.

3. The handheld device as claimed in claim 1, wherein the antenna radiator is further for transmitting a radio frequency signal with a second wavelength, and the peripheral area of the frame body further has a second ground point electrically connected to the ground plane, wherein a length of a first current path formed along the outer frame between the first ground point and the second ground point is equal to half of the second wavelength.

4. The handheld device as claimed in claim 3, wherein the antenna radiator is further for transmitting a radio frequency signal with a third wavelength, the peripheral area of the frame body further has a third ground point electrically connected to the ground plane, wherein a length of a second current path formed along the outer frame between the first ground point and the third ground point is equal to half of the third wavelength, and the first current path and the second current path are not overlapped by each other.

5. The handheld device as claimed in claim 4, wherein the spacing between the second ground point and the third ground point is equal to the spacing between the first ground point and the projected feeding point.

6. The handheld device as claimed in claim 1, further comprising:

a substrate, opposite to the outer frame, wherein the antenna area is electrically connected to the ground plane via the ground part;

a metallic inner-frame, engaged with the carrier and electrically connected to the ground plane; and a conductive material layer, overlays the frame body, the carrier and the metallic inner-frame thereon with respect to the first ground point, so that the first ground point is electrically connected to the ground plane via the conductive material layer and the metallic inner-frame.

7. The handheld device as claimed in claim 6, wherein the surface of the frame body further comprises a metallic thin film, wherein the conductive material layer overlays the metallic thin film thereon, so that the first ground point on the frame body is electrically connected to the ground plane via the metallic thin film, the conductive material layer and the metallic inner-frame.

8. The handheld device as claimed in claim 6, wherein the conductive material layer overlays the frame body thereon, so that the first ground point on the frame body is electrically connected to the ground plane via the conductive material layer and the metallic inner-frame.

9. The handheld device as claimed in claim 6, wherein the conductive material layer is a metallic spring, a gasket, a conductive tape or a conductive painting.

10. The handheld device as claimed in claim 6, further comprising:

a plurality of fastening elements, for passing through the metallic inner-frame, the carrier and the substrate so as to fasten the metallic inner-frame and the carrier on the substrate, wherein the metallic inner-frame is electrically connected to the ground plane via the fastening elements.

11. The handheld device as claimed in claim 4, further comprising:

a metallic inner-frame, engaged with the carrier and electrically connected to the ground plane; and a conductive material layer, overlays the frame body, the carrier and the metallic inner-frame thereon with respect to the first, second and third ground points, so that the first, second and third ground points are electrically connected to the ground plane via the conductive material layer and the metallic inner-frame.

12. The handheld device as claimed in claim 11, wherein the second ground point and the third ground point are the spots on the frame body with the strongest current density.

* * * * *